US006531819B1

(12) United States Patent
Nakahara et al.

(10) Patent No.: US 6,531,819 B1
(45) Date of Patent: Mar. 11, 2003

(54) SURFACE DISCHARGE PLASMA DISPLAY PANEL

(75) Inventors: Masahiro Nakahara, Kagoshima (JP); Yoshikazu Kanazawa, Kawasaki (JP); Ryuji Tazume, Kagoshima (JP); Shinichi Nomura, Kagoshima (JP); Mitsuhiro Moriyama, Kagoshima (JP); Yukinori Miyazaki, Kagoshima (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/481,324

(22) Filed: Jan. 11, 2000

(30) Foreign Application Priority Data

Feb. 24, 1999 (JP) ..... 11-046717

(51) Int. Cl.[7] ..... H01J 17/49
(52) U.S. Cl. ..... 313/584; 313/585
(58) Field of Search ..... 313/491, 492, 313/584, 581, 582, 583, 585, 586

(56) References Cited

U.S. PATENT DOCUMENTS

| | | | | |
|---|---|---|---|---|
| 4,190,788 A | * | 2/1980 | Yoshikawa et al. | 315/169.4 |
| 5,640,068 A | | 6/1997 | Amemiya | |
| 5,900,694 A | | 5/1999 | Matsuzaki et al. | |
| 6,140,774 A | * | 10/2000 | Mori et al. | 313/491 |
| 6,160,348 A | * | 12/2000 | Choi | 313/584 |
| 6,288,488 B1 | * | 9/2001 | Amemiya | 313/582 |
| 2001/0026130 A1 | * | 10/2001 | Amemiya et al. | 313/586 |

FOREIGN PATENT DOCUMENTS

| | | |
|---|---|---|
| EP | 0 908 919 | 4/1999 |
| JP | 8-22772 | 1/1996 |
| JP | 9-120777 | 5/1997 |
| JP | 9-129138 | 5/1997 |
| JP | 9-251842 | 9/1997 |
| JP | 0 802 556 | 10/1997 |
| JP | 10-321142 | 12/1998 |
| JP | 0 936 655 | 8/1999 |
| WO | 98/44531 | 10/1998 |

OTHER PUBLICATIONS

Patent Abstracts of Japan, vol. 1997, No. 09, Sep. 30, 1997 of JP 09 120777 A (Hitachi LTD), May 6, 1997.

* cited by examiner

*Primary Examiner*—Nimeshkumar D. Patel
*Assistant Examiner*—Thelma Sheree Clove
(74) *Attorney, Agent, or Firm*—Staas & Halsey LLP

(57) ABSTRACT

A plasma display panel of a surface discharge type is disclosed, which can positively generate the discharge for display while suppressing the power consumption even when the number of the electrodes is increased for attaining the high definition. A plurality of display electrode pairs are arranged in proximity with each other inside of a pair of substrates opposed to each other with a discharge gap formed therebetween. Each display electrode includes a main pattern extending in one direction, independent discharge patterns each formed for each luminous area corresponding to a display cell, and a plurality of auxiliary patterns for electrically connecting the main pattern and the discharge patterns to each other. The auxiliary patterns are higher in conductivity than the discharge patterns.

21 Claims, 17 Drawing Sheets

SURFACE DISCHARGE PLASMA DISPLAY PANEL

BACKGROUND OF THE INVENTION

The present invention relates to a plasma display panel of a surface discharge type having a plurality of display electrodes constituting sustain discharge electrode pairs arranged adjacent to each other.

The plasma display panel is attracting attention as a display device of wall type, and a vigorous effort is under way for improving the image quality by improving the resolution and suppressing the power consumption.

First, an explanation will be given of the structure of an AC-driven 3-electrode plasma display panel of a surface discharge type (hereinafter referred to as PDP). FIG. 1 is a perspective view showing a part of the PDP. As shown in FIG. 1, display electrodes (also called sustain electrodes) X, Y for generating the surface discharge along the surface of a substrate are arranged, at the rate of a pair on each row L of the matrix display, on the inner surface of a front substrate 100 of a transparent glass material. The display electrodes X, Y, are formed by photolithography and, as described in detail later, are each configured with a transparent electrode 102 and a bus electrode 103 of a metal thin film of a multilayer structure. In order to cover the display electrodes X, Y and the discharge space, a dielectric layer 104 for AC drive is formed by screen printing. A protective film 105 of MgO (magnesium oxide) is deposited by evaporation on the surface of the dielectric layer 104.

On the other hand, a plurality of address electrodes 106 for generating the address discharge are arranged at a predetermined pitch at right angles to the display electrodes X, Y on the inner surface of the back substrate 101. The address electrodes 106 are also formed by photolithography and are made of a metal film of a multilayer structure like the bus electrodes 103. A dielectric layer 107 is formed by screen printing over the whole surface of the back substrate 101 including the address electrodes 106. Linear partitioning walls 108 about 150 $\mu$m tall, one each between each pair of the address electrodes 106, are formed on the dielectric layer 107. Phosphor bands 110 of the three primary colors R (red), G (green), B (blue) for full color display are formed, by screen printing, in such a manner as to cover the surface of the dielectric layer 107 and the sides of the partitioning walls 108 above the address electrodes 106. Also, a discharge gas such as Ne—Xe (a mixed gas of Ne and Xe) for exciting the phosphor material by radiating ultraviolet light at the time of discharge is sealed in the discharge space 109 under the pressure of about several tens of KPa (several hundred torr). A seal member 111 is formed along the peripheral edge of the substrates for sealing the discharge space 109. The front substrate 100 and the back substrate 101 are formed separately from each other, are attached to each other and are fixed by the seal member 111, thus completing the PDP.

FIGS. 2A and 2B are a plan view and a sectional view, respectively, showing the structure of the display electrodes of the conventional PDP. The same component parts as the corresponding parts in FIG. 1 are designated by the same reference numerals, respectively. As explained with reference to FIG. 1, the display electrodes X, Y constitute a pair, and are each comprised of a wide transparent electrode 102 and a narrow transparent electrode 103 as seen from FIG. 2A.

The bus electrode 103 is made of a multilayer metal such as Cr—Cu—Cr taking the conductivity and the matching with the surrounding film into consideration. The transparent electrode 102 is adapted to transmit light to prevent a reduction in luminous efficacy. The bus electrodes of the multilayer metal compensate for the insufficient conductivity of the transparent electrode 102. The bus electrode 103 is arranged on the outside of each transparent electrode 102 thereby to form a luminous area 112 between the two bus electrodes 103. Each luminous area 112 is defined by the partitioning walls 108 indicated by dashed lines formed on the back substrate in opposed relation to the address electrode 106 indicated by one-dot chains in FIG. 2A.

FIG. 2B is a cross sectional view of the display electrode taken along the arrow in FIG. 2A. To complement the foregoing description with reference to FIG. 1, as shown in FIG. 2B, the transparent electrodes 102 are formed in contact with the inner surface of the front substrate 100, and the bus electrodes 103 are deposited on a part of the transparent electrodes 102, respectively. Also, though not shown in FIG. 2A, the dielectric member 104 is formed in such a manner as to cover the transparent electrodes 102 and the bus electrodes 103, and a protective film 105 is formed on the dielectric member 104.

In this structure, the main discharge is generated between the display electrodes X and Y to emit light from the portion selected by the address electrodes 106. In the light emission, the ultraviolet light generated by the discharge excites the phosphor member 110 (FIG. 1) and appears as visible light on the front substrate 100.

In recent years, the trend has been toward an increased number of pixels, to meet an HDTV requirement, at the sacrifice of increased power consumption. Specifically, a higher definition of the screen of the same size increases the number of electrodes and hence the area occupied by the electrodes, resulting in a correspondingly increased power consumption. Japanese Unexamined Patent Publication No. 8-22772 discloses a PDP in which the power consumption is suppressed by changing the pattern of the wide transparent electrode and thus the area thereof is reduced. FIG. 3 is a plan view showing the display electrode pattern for reducing the power consumption disclosed in the same publication. As shown in FIG. 3, each transparent electrode 122 of the display electrodes X, Y includes a plurality of protrusions 122*a* extending in the direction perpendicular to the main pattern and each having, at the forward end thereof, a discharge unit 122*b* of a width required for discharge. This pattern shape can reduce the area of the transparent electrodes 122 remarkably. The bus electrodes 123 are formed on the outside of the transparent electrodes 122, respectively, in the same manner as explained with reference to FIG. 2.

The discharge is generated at the opposed portions of the adjacent transparent electrodes 122. The portions defined by the partitioning walls 128 opposed to the address electrodes 126 on the back substrate constitute a luminous area 129. Therefore, the opposed portions of the transparent electrodes 122, as long as they are in a predetermined spaced relation with each other in the luminous area 129, can generate the desired discharge. In view of this, as shown in FIG. 3, a pattern formed with the discharge potions 122*b* having a predetermined width through the protrusions 122*a*, respectively, can generate a discharge without any problem. Thus, the power consumption can be reduced by reducing the area of the transparent electrodes 122.

In spite of this, it has been found that the pattern described above for reducing the area is accompanied by another problem. Specifically, in view of the fact that the transparent electrode film as thin as several thousand A may cause a disconnected portion 130 at the time of patterning under the effect of the dust or a scratch or other damage on the surface of the substrate. The disconnected portion 130 of the protrusion 122*a* cuts off the conduction to the discharge unit 122*b* and thus naturally prevents the discharge.

U.S. Ser. No. 5640068, on the other hand, discloses a PDP with the brightness increased by reducing the shielding area of the luminous area. FIG. 4 is a plan view showing a display electrode pattern for reducing the shielding area disclosed by the well-known reference. As shown in FIG. 4, each transparent electrode 142 of the display electrodes X, Y extends in parallel to the main pattern 143, and the transparent electrode 142 and the main pattern 143 are electrically connected to each other through a plurality of connecting patterns 144 extending in a direction perpendicular to the main pattern 143. The bus electrode 123, like the one explained with reference to FIG. 2, is formed on the outside of the transparent electrode 122. The connecting pattern 144, which is formed of a shielding metal material, is formed in overlapped relation with the partitioning wall 148 and therefore the luminous area 149 is not shielded. In this pattern, however, the current flows along the transparent electrodes 142 and therefore the power consumption cannot be reduced.

SUMMARY OF THE INVENTION

The object of the present invention is to provide a plasma display panel of a surface discharge type capable of generating a discharge for display positively while suppressing the power consumption to low level even with an increased number of electrodes for realizing a high definition.

According to a first aspect of the invention, there is provided a plasma display panel of a surface discharge type, comprising an discharge pattern for each luminous area corresponding to each display cell, in which each main pattern and the corresponding discharge patterns are electrically connected to each other by at least an auxiliary pattern of higher conductivity than the discharge patterns.

Specifically, the plasma display panel of a surface discharge type according to the first aspect of the invention comprises a pair of substrates arranged in opposed relation to each other with a discharge space therebetween and a plurality of display electrode pairs arranged, in proximity to each other, inside the substrates, wherein each display electrode includes a main pattern extending in one direction, a plurality of discharge patterns formed for each luminous area corresponding to a display cell, and a plurality of auxiliary patterns for electrically connecting the main pattern and the discharge patterns to each other, and wherein the auxiliary patterns are higher in conductivity than the discharge patterns.

In the first aspect of the invention, the provision of the discharge patterns at positions protruded from the main pattern in the direction at right angles to the main pattern of the display electrode can suppress the power consumption by reducing the intermediate pattern area. At the same time, the main pattern and the discharge patterns are connected to each other by the auxiliary patterns made of a material having a high conductivity, and therefore a sufficient conductivity can be secured between the main pattern and the discharge patterns.

BRIEF DESCRIPTION OF THE DRAWINGS

The feature and advantages of the invention will be more clearly understood from the following description taken in conjunction with the accompanying drawings, in which.

DESCRIPTION OF THE PREFERRED EMBODIMENTS

Figure 1:
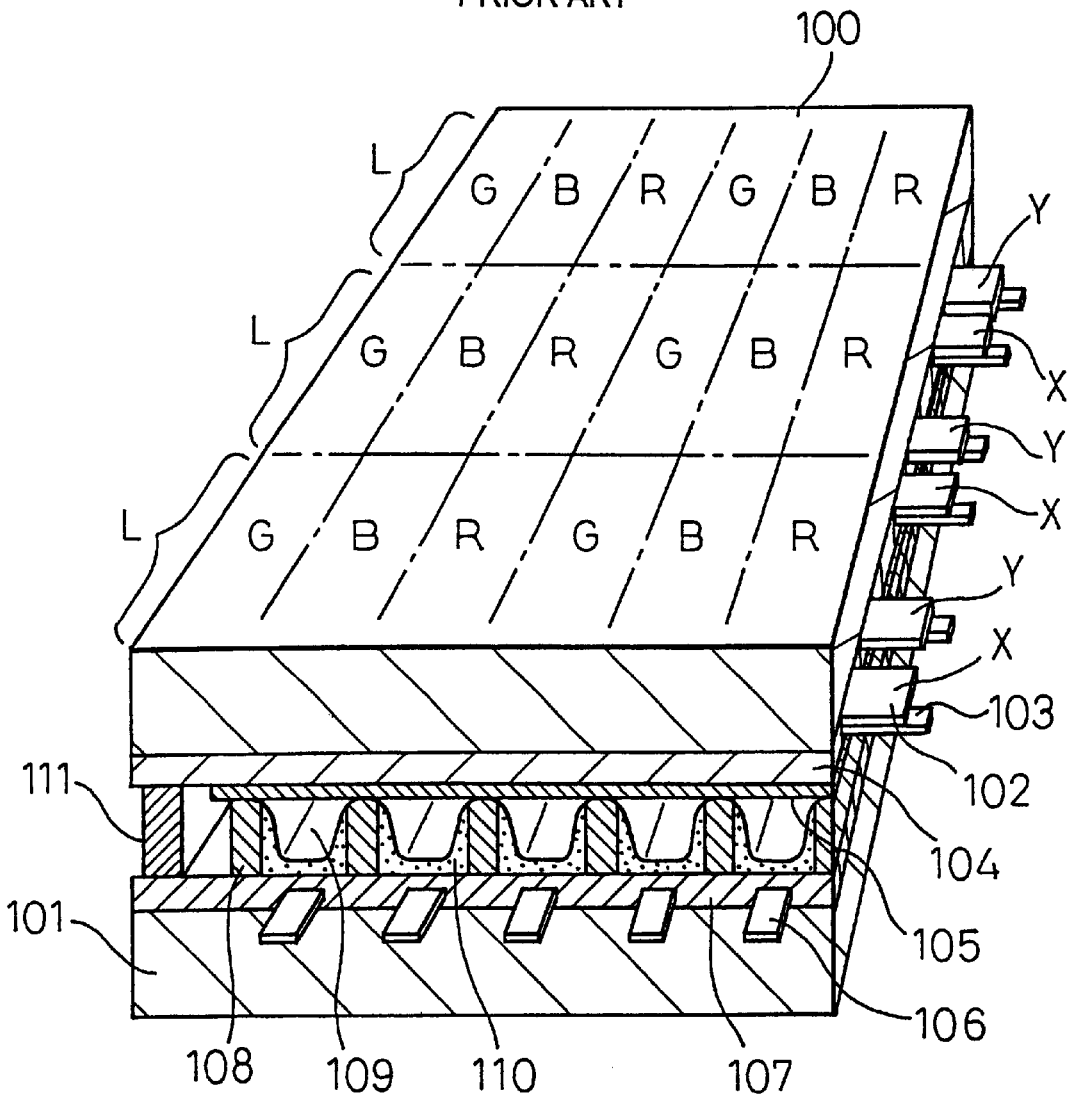
Fig.1 PRIOR ART
FIG. 1 is a perspective view for explaining the structure of a plasma display panel of a surface discharge type.
Figure 2A:
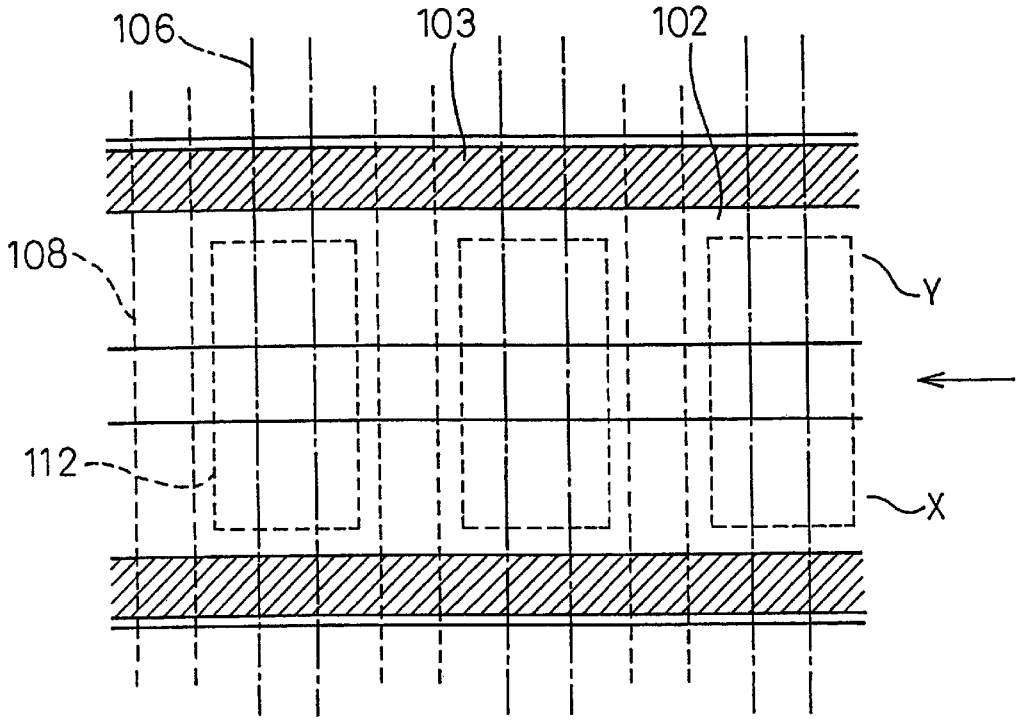
Fig. 2A PRIOR ART
FIGS. 2A and 2B are a plan view and a sectional view, respectively, of the display electrodes of the conventional PDP.
Figure 2B:
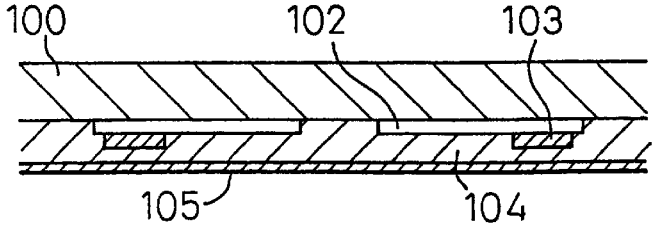
Fig. 2B PRIOR ART
Figure 3:
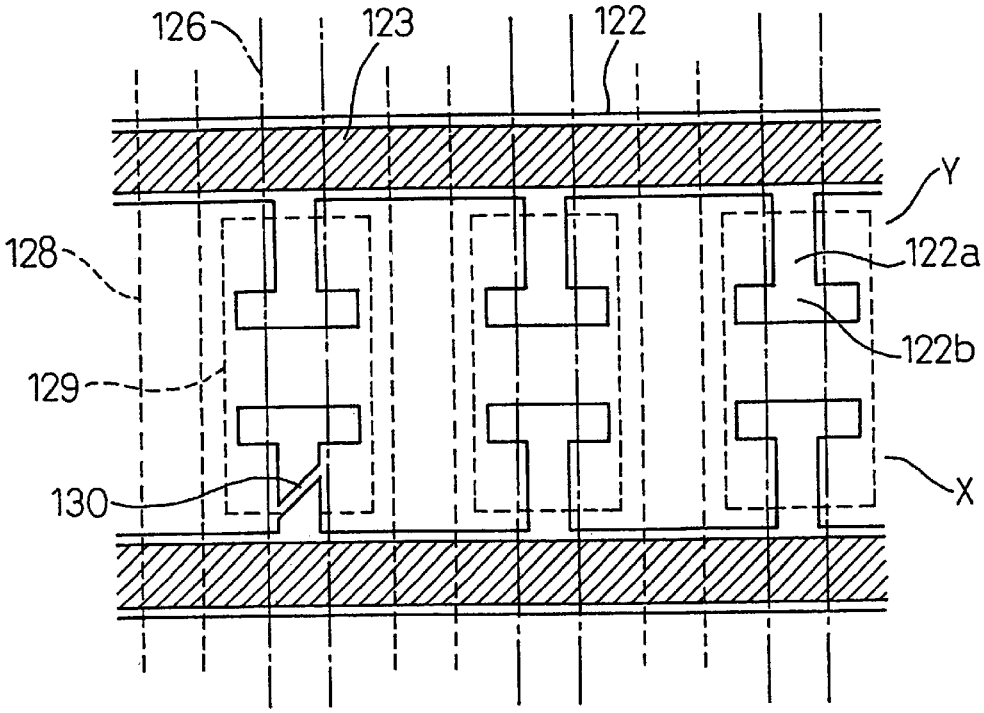
Fig. 3 PRIOR ART
FIG. 3 is a plan view of a display electrode pattern of the conventional PDP for low power consumption.
Figure 4:
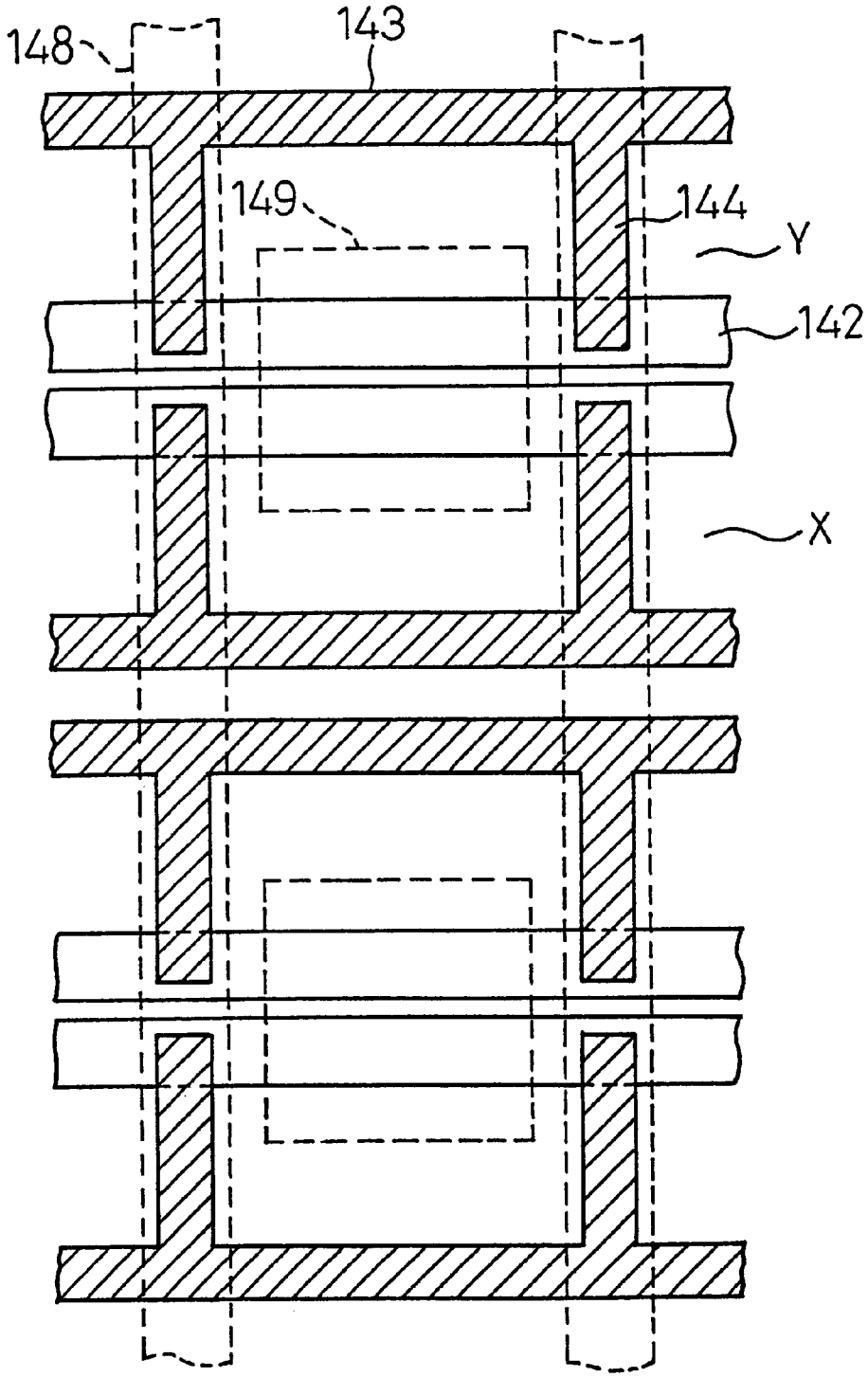
Fig.4 PRIOR ART
FIG. 4 is a plan view of the display electrode pattern for reducing the shielding of the luminous area of the conventional PDP.

Embodiments of the present invention will be explained below with reference to the drawings. A surface discharge PDP according to the invention has a feature in the structure of the display electrodes making up sustain electrode pairs, i.e. the shape of the pattern thereof. The configuration other than the pattern shape of the display electrodes is the same as the conventional configuration shown in FIG. 1, for example, and will not be described below.

Figure 5:
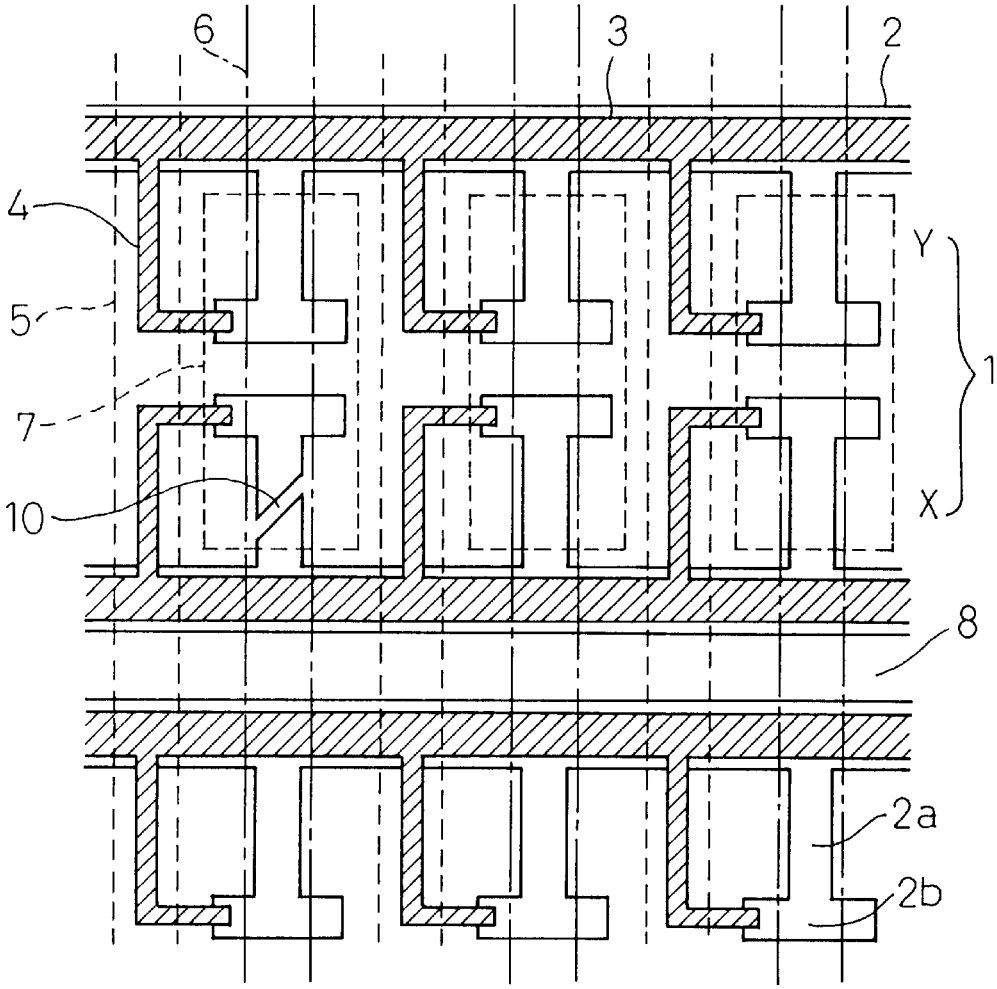
FIG. 5 is a plan view of the display electrodes according to a first embodiment of the invention.
Figure 6:
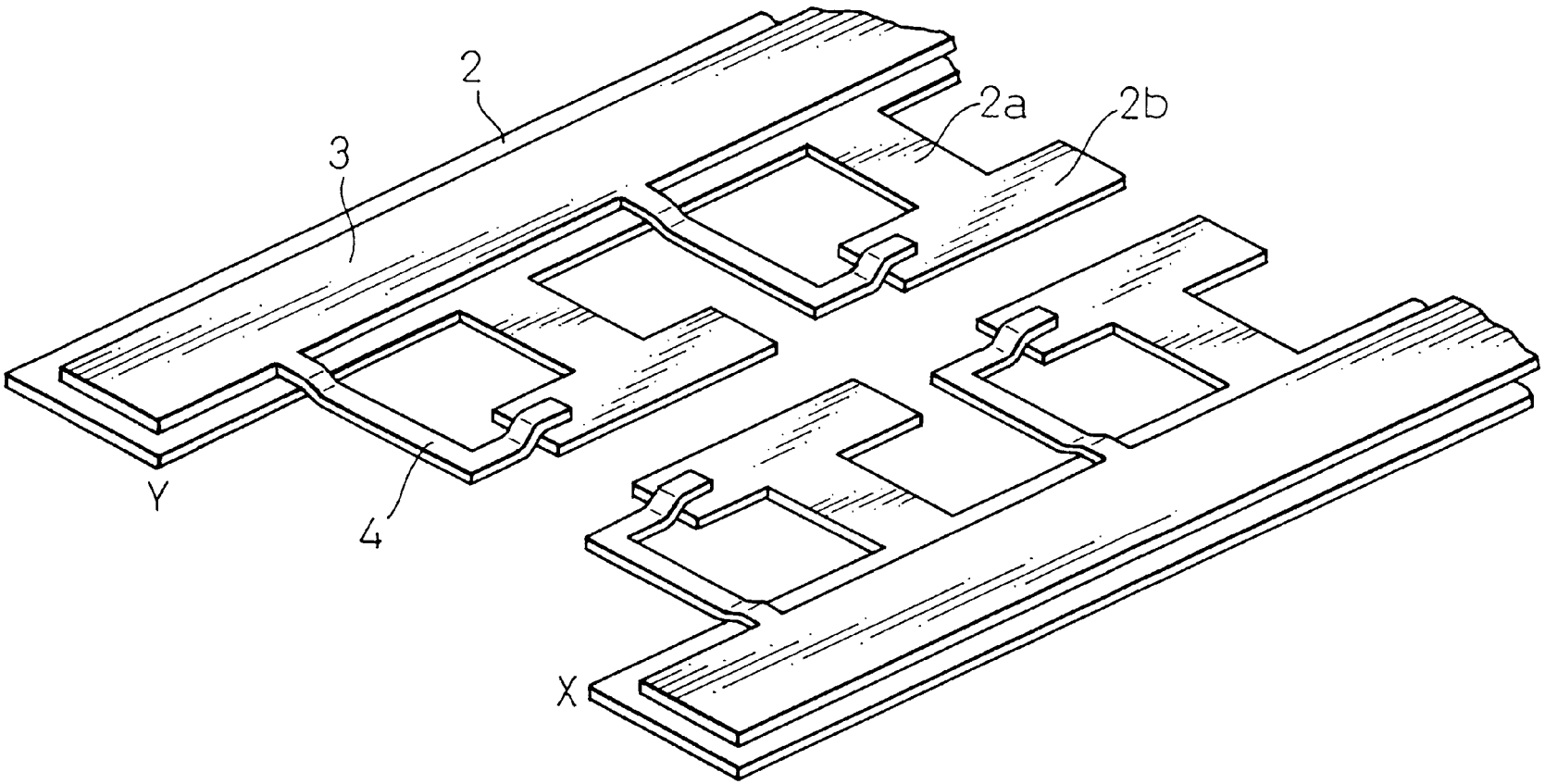
FIG. 6 is a perspective view of the display electrodes according to the first embodiment of the invention.

FIGS. 5 and 6 are diagrams showing a pattern shape of the display electrodes of the PDP according to a first embodiment of the invention. FIG. 5 is a plan view, and FIG. 6 is a perspective view. As shown in FIG. 5, display electrodes X, Y constitute a display electrode pair for generating a sustain discharge. (See corresponding display electrode pairs 1 in FIG. 7, 11 in FIGS. 8–12, 51 in FIG. 15, 61 in FIG., 16, 71 in FIG. 17 and 81 in FIG. 18.) The display electrodes X, Y are each formed of a transparent electrode of ITO, etc. and a bus electrode 3 of a Cr—Cu—Cr or the like metal layer. These display electrodes are symmetrically arranged in opposed relation to each other. The structure of the transparent electrode 2 and the bus electrode 3 is clear from the perspective view of FIG. 6. The transparent electrode 2 includes a plurality of protrusions 2*a* extending in the direction perpendicular to a band-shaped main pattern and a plurality of discharge portions 2*b* of a predetermined width each formed at the forward end of the corresponding protrusion 2*a*. The protrusions 2*a* and the discharge portions 2*b* are arranged a predetermined intervals. The discharge portions 2*b* of adjacent display electrode pairs 1 are arranged in opposed relation to each other and the discharge occurs between the discharge portions 2*b*. On the other hand, the bus electrode 3 is also formed in the shape of a band on the main pattern of the transparent electrode 2, and a plurality of auxiliary patterns 4 extending the direction perpendicular to the band-shaped portion are connected to the discharge portions 2*b*, respectively, of the transparent electrode 2. The bus electrode 3 is made of a Cr—Cu—Cr multilayer metal and is so small in electrical resistance that is formed in the thickness of several $\mu$m and is not disconnected in an elongated pattern.

Even in the case where the protrusion 2*a* of the transparent electrode 2 is disconnected at a portion designated by 10, the discharge unit 2*b* of the transparent electrode 2 conducts through the auxiliary pattern 4 of the bus electrode 3, thus making it possible to generate the discharge without fail.

A major portion of each auxiliary pattern 4 of the bus electrode 3 is arranged in overlapped relation with the corresponding one of the partitioning walls 5 (indicated by dashed lines in FIG. 5) on the back substrate. Therefore, only a small portion of the auxiliary pattern 4 interrupts the luminous area 7 and therefore the luminous efficacy is not reduced. (See corresponding luminous areas 17 in FIGS. 8–12, 57 in FIG. 15, 67 in FIG. 16, 77 in FIG. 17 and 87 in FIG. 18.) Also, the presence of the auxiliary pattern 4 overlapped with the partitioning wall 5 reduces the external light reflectance and improves the contrast. (See corresponding partitioning walls 5 in FIG. 7, 15 in FIGS. 8–12, 55 in FIG. 15, 65 in FIG. 16, 75 in FIG. 17 and 85 in FIG. 18.) Specifically, the portion of the partitioning wall 5 in contact with the back substrate not only fails to contribute to the light emission but also increases the reflection of the external light as the result of phosphor particles attaching and whitening, thereby reducing the contrast. In the present embodiment, by contrast, the metal auxiliary pattern 4 is black and suppresses the reflection of the external light.

The address electrodes 6 are each arranged between the partitioning walls of the back substrate in such a manner as to pass a portion of the transparent electrode 2 and cause the crossing point with the selected display electrode pair 1 to emit light. (See corresponding address electrodes 6 in FIG. 7, 16 in FIG. 8, 56 in FIG. 15, 66 in FIG. 16, 76 in FIG. 17 and 86 in FIG. 18.) In, the PDP, a multiplicity of such display electrode pairs 1 are arranged alternating with non-display slits 8.

Figure 7:
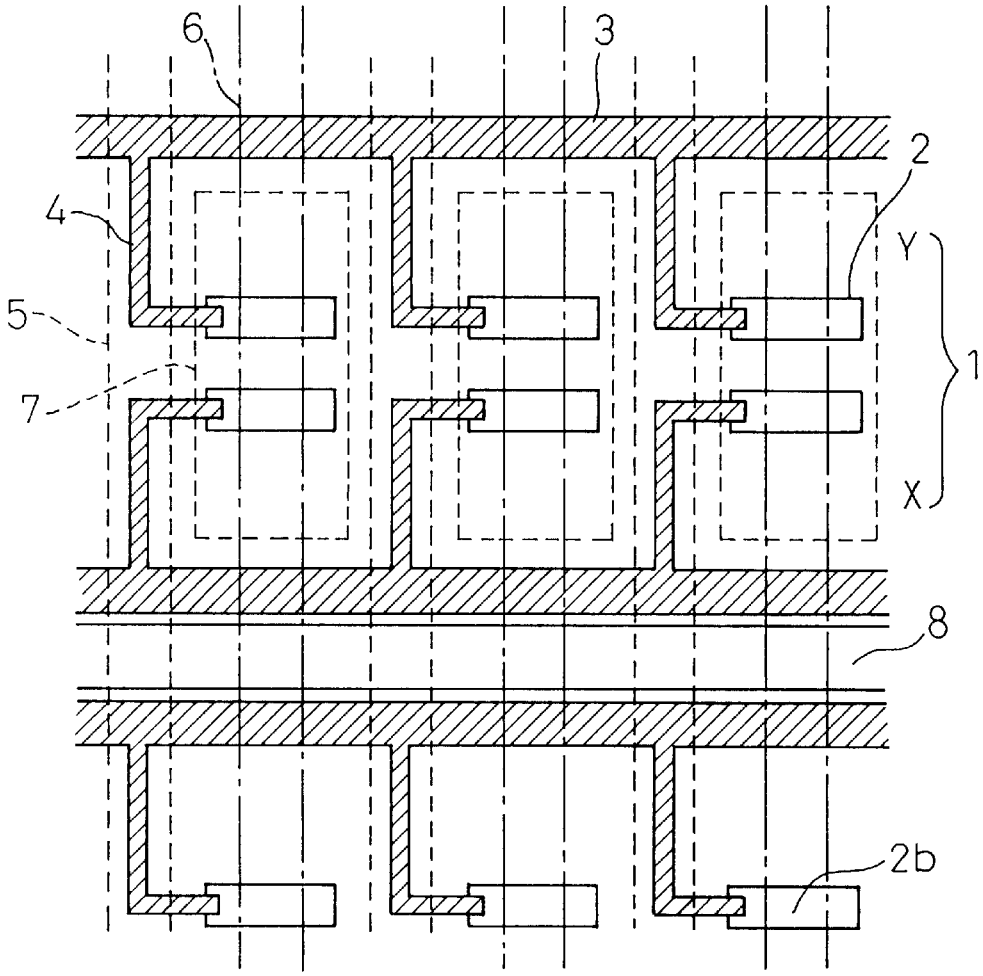
FIG. 7 is a plan view of the display electrodes according to a second embodiment of the invention.

In the display electrodes described above, first, the transparent electrode 2 is formed into a predetermined pattern, and then a multilayer metal is formed by sputtering. By patterning this multilayer metal, the bus electrode 3 is formed to complete the process. As shown in FIG. 7, the bus electrode 3 formed later constitutes a pattern having a step with the transparent electrode 3. Since the transparent electrode 2 is a film as thin as several thousand A, however, the step has no adverse effect.

Also, the area of the main pattern of the bus electrode 3 is reduced by an amount corresponding to the auxiliary patterns 4. Specifically, the total area is kept constant in order to secure the desired conductivity. Thus, the power consumption is not increased by forming the auxiliary patterns 4. Further, each transparent electrode 2 is spaced from the transparent electrodes 2 in adjacent luminous areas 7, and therefore the expansion of the discharge due to the discharge between the adjacent portions is limited so as not to reduce the resolution.

FIG. 7 is a plan view showing a pattern shape of the display electrodes of the PDP according to a second embodiment of the invention. As shown in FIG. 7, the pattern of the transparent electrodes 2 is different from the corresponding pattern of the first embodiment.

In the second embodiment, each transparent electrode 2 is only an island-like discharge portion and lacks the protrusions extending from the main pattern unlike the first embodiment. This is intended to utilize the auxiliary patterns 4 of the bus electrode 3 positively but not merely as a supplement in case of disconnection. The partitioning walls 5 and the address electrodes 6 are formed on the back substrate at the same positions as in the first embodiment for defining the luminous areas 7. Also, the transparent electrodes 2 are not arranged over the whole lower surface of the bus electrode 3, thereby further reducing the power consumption. According to the pattern shape of this embodiment, the area of the transparent electrodes 2 can be further reduced for further reduction in power consumption. Each transparent electrode 2 is electrically connected by the corresponding metal auxiliary pattern 4 and therefore is not disconnected.

Figure 8:
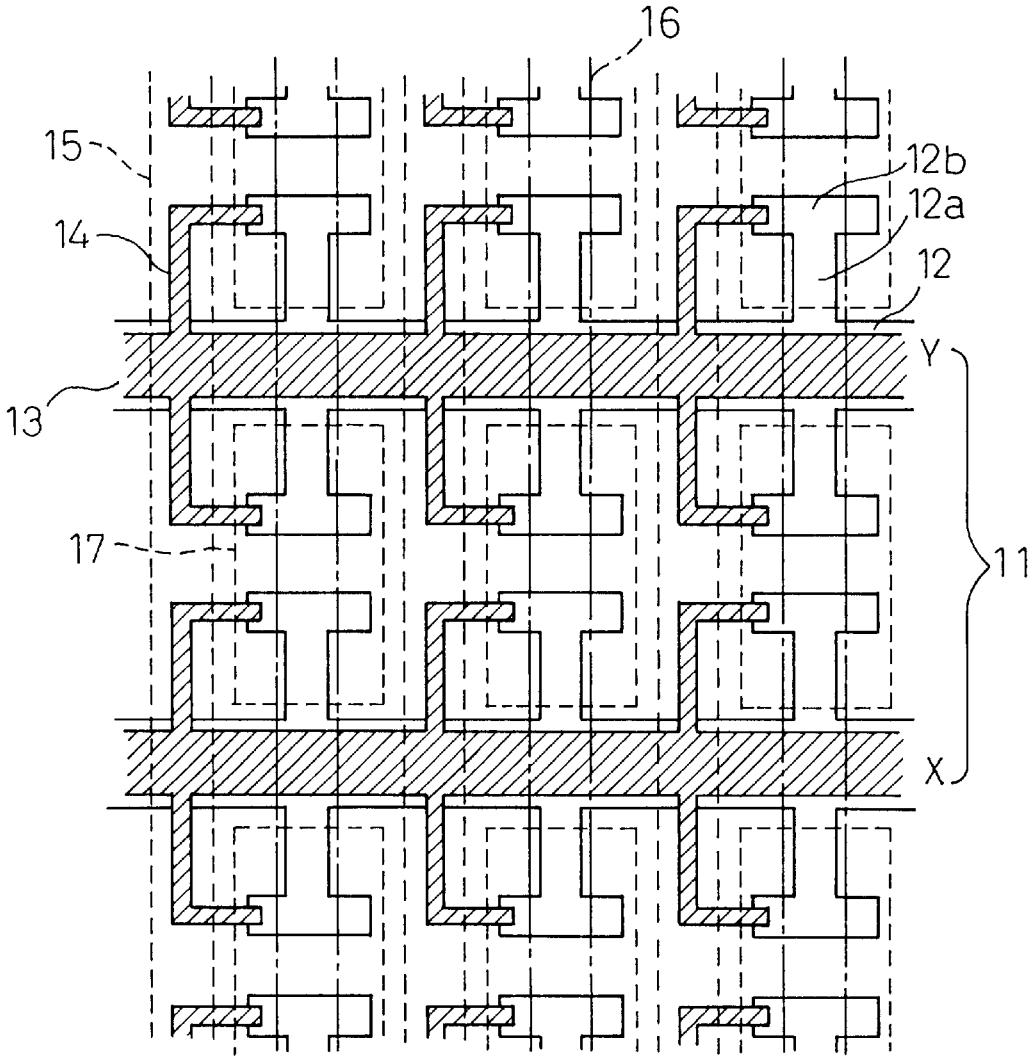
FIG. 8 is a plan view of the display electrodes according to a third embodiment of the invention.
Figure 9:
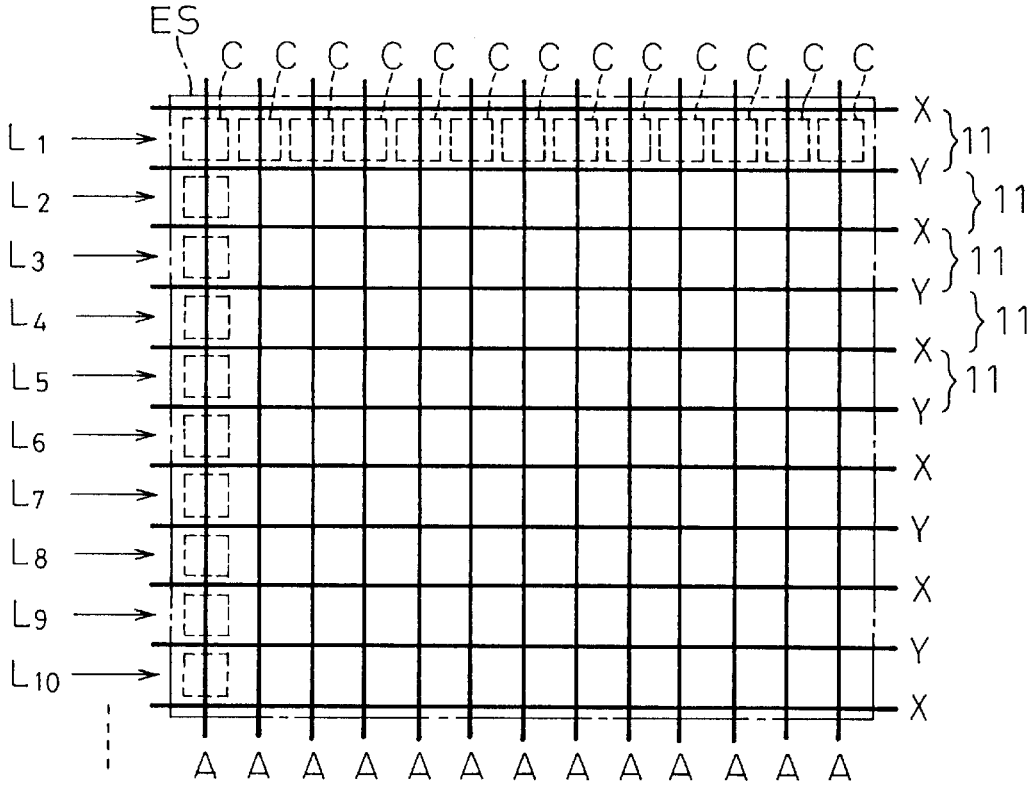
FIG. 9 is a diagram showing an electrode matrix and display cells according to the third embodiment.
Figure 10:
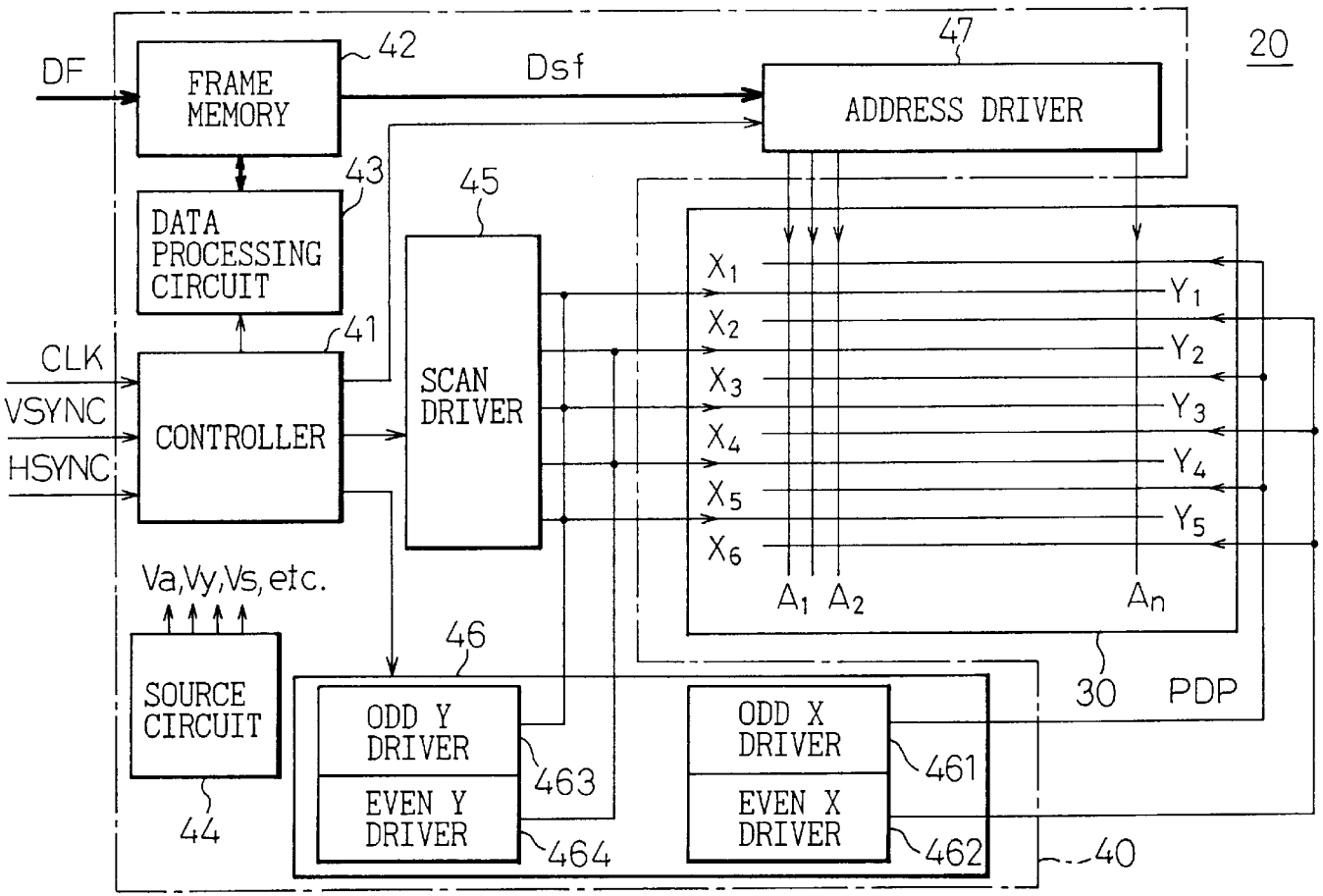
FIG. 10 is a block diagram showing a configuration of a plasma display apparatus according to the third embodiment.
Figure 11:
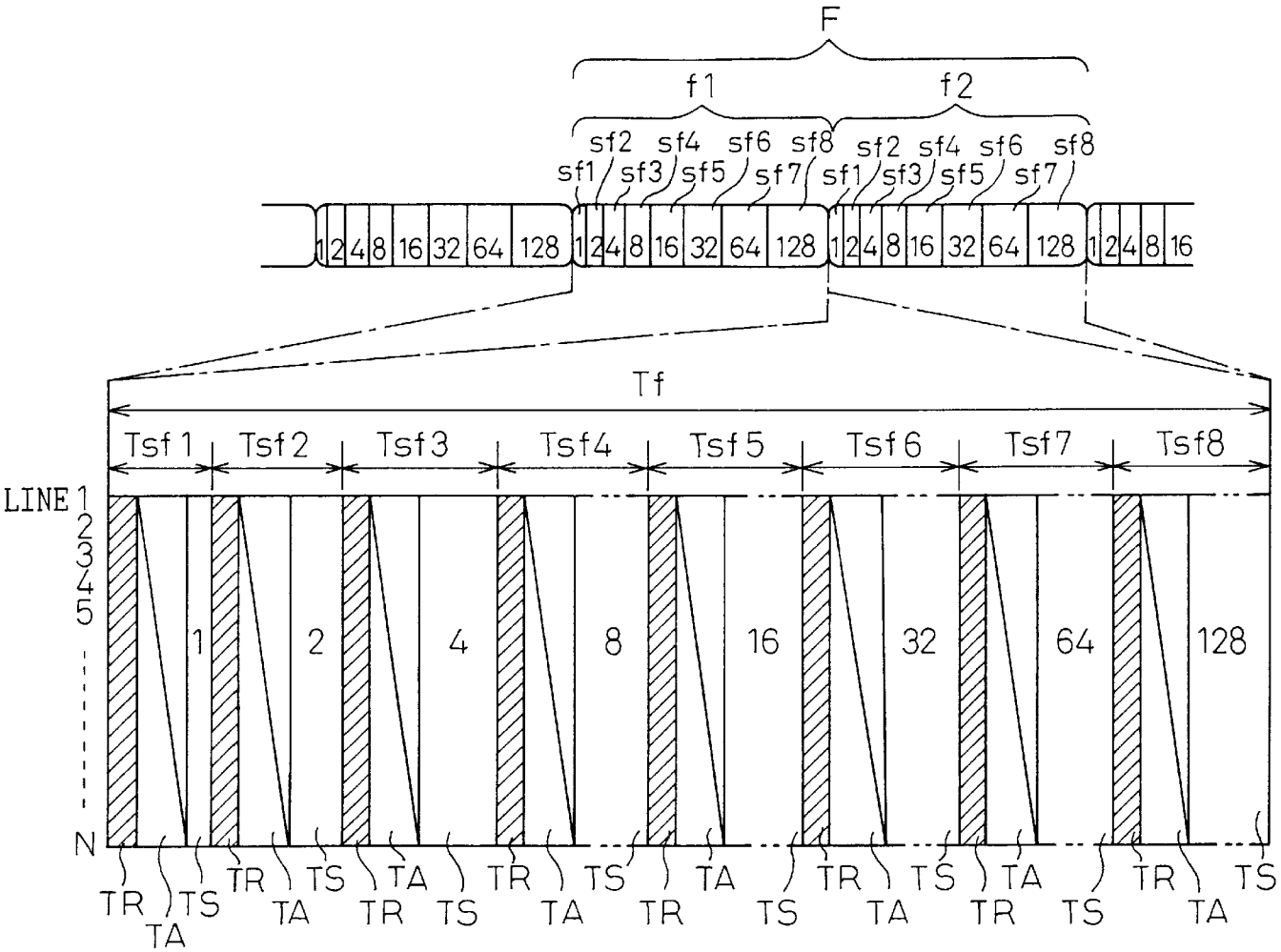
FIG. 11 is a diagram showing a frame structure for gray scale display of a plasma display apparatus according to the third embodiment.

FIGS. 8 to 12 are diagrams for explaining the PDP according to the third embodiment of the invention. FIG. 8 shows a pattern shape of the display electrodes, FIG. 9 shows a model of electrode matrix, FIG. 10 is a block diagram showing a configuration of the plasma display unit including a drive unit, FIG. 11 shows a frame structure for gray level display, and FIG. 12 voltage waveforms indicating a drive sequence.

The PDP according to the first and second embodiments is configured of a multiplicity of display electrode pairs 11 isolated by non-display slits. The third embodiment, on the other hand, is applicable to the PDP of what is called the ALiS (alternate light of surfaces method) system without any non-display slits. This system is especially effective for the invention. This system is especially effective for the invention.

In the ALiS system, every other electrode is alternately discharged so that all the inter-electrode gaps are efficiently utilized for light emission. The details of the driving will be described later with reference to FIGS. 9 to 12. This drive system is considered essential to the HDTV or digital broadcasting, and can very effectively suppress the power consumption.

According to the third embodiment, as shown in FIG. 8, the display electrodes X, Y constitute a display electrode pair 11 for generating the sustain discharge. The display electrodes X, Y, like the first and second embodiments, are each made of a transparent electrode 12 of ITO or the like and the bus electrode 13 of a multilayer metal. These component parts are arranged in symmetrically opposed relation to each other. The bus electrode 13 is a band-shaped pattern, from the two sides of which the auxiliary patterns 14 extend in opposite directions. The Cr (chromium) film of the bus electrode 13 is black and opaque and therefore the band-shaped pattern prevents transmission through the phosphor material on the back substrate through the front substrate while at the same time blocking the leakage of the discharge light of the adjacent cells. Thus, the band-shaped pattern functions as what is called a black stripe.

On the other hand, the transparent electrode 12 is electrically connected to the band-shaped pattern of the bus electrode 12 and includes, in a predetermined spaced relation, a plurality of protrusions 12*a* extending from the two sides of the pattern and a plurality of discharge portions 12*b* of a predetermined width arranged at the forward end of the protrusions 12*a* and connected to the auxiliary patterns 14, respectively, of the bus electrode 13. The discharge portions 12*b* of adjacent display electrodes are arranged in opposed relation to each other for generating the discharge between them.

As described above, the display electrodes X, Y of each pair 11 according to this embodiment have a pattern including a central main band-shaped pattern and protrusions extending from the two sides of the main pattern thereby to define each luminous area 17 without any non-display slits, thereby meeting the ALiS system drive requirements. The partitioning walls 15 and the address electrodes 16 are formed on the back substrate at positions similar to those in the first and second embodiments for defining the luminous areas 17.

Also in this embodiment meeting the drive requirement of the ALiS system, a protrusion 12*a* of the transparent electrode 12 may be disconnected. As in the first embodiment, the corresponding discharge portion 12*b* of the transparent electrode 12 conducts through the corresponding auxiliary pattern 14 of the bus electrode. Therefore, in spite of the pattern shape of low power consumption type, the discharge can be positively generated.

Apart from the fact that the auxiliary patterns 14 are symmetric about the main pattern of the bus electrode 13, a similar effect is produced by an asymmetric arrangement (or an arrangement symmetric about a point) in which the discharge portions 12*b* of the transparent electrode 12 are connected in alternately opposite directions. Arranging the transparent electrode 12 under the band-shaped pattern of the bus electrode 13 with the intention of increasing the bonding power is not always necessary. For example, a T pattern configured with the protrusion 12*a* and the discharge portion 12*b* or an I pattern with the protrusions 12*a* connected to each other on the two sides of the bus electrode 13 can also be employed.

In the surface discharge PDP according to this embodiment, as shown in FIG. 9, M address electrodes A are arranged as column electrodes, and (N+1) pairs 11 of display electrodes X, Y are arranged alternately and equidistantly in the direction perpendicular to the address electrodes A. Character M designates the number of columns and character N the number of rows on the screen ES. The intervals between the display electrodes X, Y are set to about several tens of $\mu$m capable of generating the surface discharge with a realistic range of drive voltage (100 V to 200 V, for example). The display electrodes X, Y drawn in FIG. 9 are thin. Actually, however, as shown in FIG. 8, each display electrode X, Y has a width larger than the interval at which they are arranged.

The display electrodes X which are odd numbered in the sequence along the columns shown in the drawing always constitute an electrically common group. The display electrodes Y which are even numbered, on the other hand, are controlled and addressed by the address electrodes A individually, and when sustaining the turn-on state, constitute a common group like the display electrodes X. The group, as it is called here, is defined as a group of odd-numbered electrodes or a group of even-numbered electrodes, which are connected as a common group as shown in FIG. 10. Among these display electrodes X, Y, a display electrode X and a display electrode Y adjacent to each other constitute a display electrode pair 11 for generating a surface discharge and defines a row L (the suffixes in the drawing indicate the row numbers) as shown in FIG. 9. Specifically, each of the display electrodes X, Y, except for the ones at the ends of the sequence, is in charge of the display on two rows L (odd row and even row), and each of the display electrodes X at the ends is in charge of the display of one row L. The row L is a set of cells C located in the same of order of arrangement on the columns.

Now, the overall configuration of the plasma display apparatus will be explained with reference to FIG. 10. As shown in FIG. 10, the plasma display apparatus 20 comprises a PDP 30 having the electrode matrix described above and a drive unit 40. The drive unit 40 includes a controller 41, a frame memory 42, a data processing circuit 43, a power source circuit 44, a scan driver 45, a sustain circuit 46 and an address driver 47. The sustain circuit 46 includes an odd X driver 461, an even X driver 462, an odd Y driver 463 and an even Y driver 464. In the drive unit 40 arranged on the back side of the PDP 30, each driver and the electrodes of the PDP are electrically connected to each other by a flexible cable not shown.

The drive unit 40 is supplied with the frame data DF in units of pixels indicating the brightness level (gradation level) of each color of R, G, B from external devices such as the TV tuner and the computer, together with the various sync signals (CLK, VSYNC, HSYNC). The frame data DF, after being temporarily stored in the frame memory 42, has the frame thereof divided into a predetermined number of subfields by the data processing circuit 43. The value of each bit of the subfield data Dsf for gradation display output from the frame memory 42 is the information indicating whether the cell turn-on is required or not or, strictly speaking, whether the address discharge is required or not in a subfield.

In the addressing operation, the scan driver 45 applies a drive voltage individually to the display electrodes Y, the odd X driver 461 applies a drive voltage to all the odd display electrodes X at a time, the even X driver 462 applies a drive voltage to all the even display electrodes X at a time, the odd Y driver 463 applies a drive voltage to all the odd display electrodes Y at a time, and the even Y driver 464 applies a drive voltage to all the even display electrodes Y at a time. Forming the display electrodes X, Y into an electrically common group is not limited to the connection on the panel described above but also applicable to the wiring within the drivers or the wiring on the connecting table as well.

The address driver 47 applies a drive voltage selectively to a total of M address electrodes A in accordance with the subfield Dsf. These drivers are supplied with predetermined power from the power source circuit 44 through a wiring conductor not shown.

Now, an example of the method of driving the PDP 30 will be explained with reference to FIG. 11. In driving the PDP 30, the frame F representing the image information of one scene is divided into odd fields f1 and even fields f2. In the odd fields f1, odd rows are displayed, while in the even fields f2, even rows are displayed. In other words, the information of one scene is displayed by interlaced fields. In order to display the gradation (color reproduction) by binary turn-on control, the odd fields f1 and the even fields f2 are each divided into eight subfields sf1 to sf8, for example. In other words, each field is replaced by a set of eight subfields sf1 to sf8. These subfields sf1 to sf8 are weighted so that the ratio of brightness thereof is substantially 1:2:4:8:16:32:64:128 thereby to set the number of times the turn-on of each of the subfields sf1 to sf8 is sustained.

The brightness of 256 gradations can be set for each color of R, G, B by combining the turn-on and turn-off in subfields. Thus, the number of colors that can be displayed is given as the third power of 256, i.e. 1,677,216. However, the subfields sf1 to sf8 are not necessarily displayed in the order of brightness weight, but the optimization is possible, for example, by arranging the subfield having a large weight at the intermediate point of the field period Tf.

The subfield period Tsfj assigned to each subfield sfj (j=1 to 8) includes an addressing preparation time TR for securing a uniform charge distribution over the whole screen, an addressing time TA for forming a charge distribution corresponding to the display contents and a sustain time TS for maintaining the turn-on state for securing the brightness corresponding to the gradation level. In each subfield period Tsfj, the length of the addressing preparation time TR and the addressing time TA is constant regardless of the brightness weight. The sustain period TS, however, is longer, the larger the weight. In other words, the length of the eight subfield periods Tsfj corresponding to one field are different from each other. In this embodiment, the brightness weight are all given as 2n (n: integer). Nevertheless, the weight can be set to other values. Further, it is possible that a plurality of subfields of the same weight existing in one field can be arranged in random sequence as described above.

Figure 12:
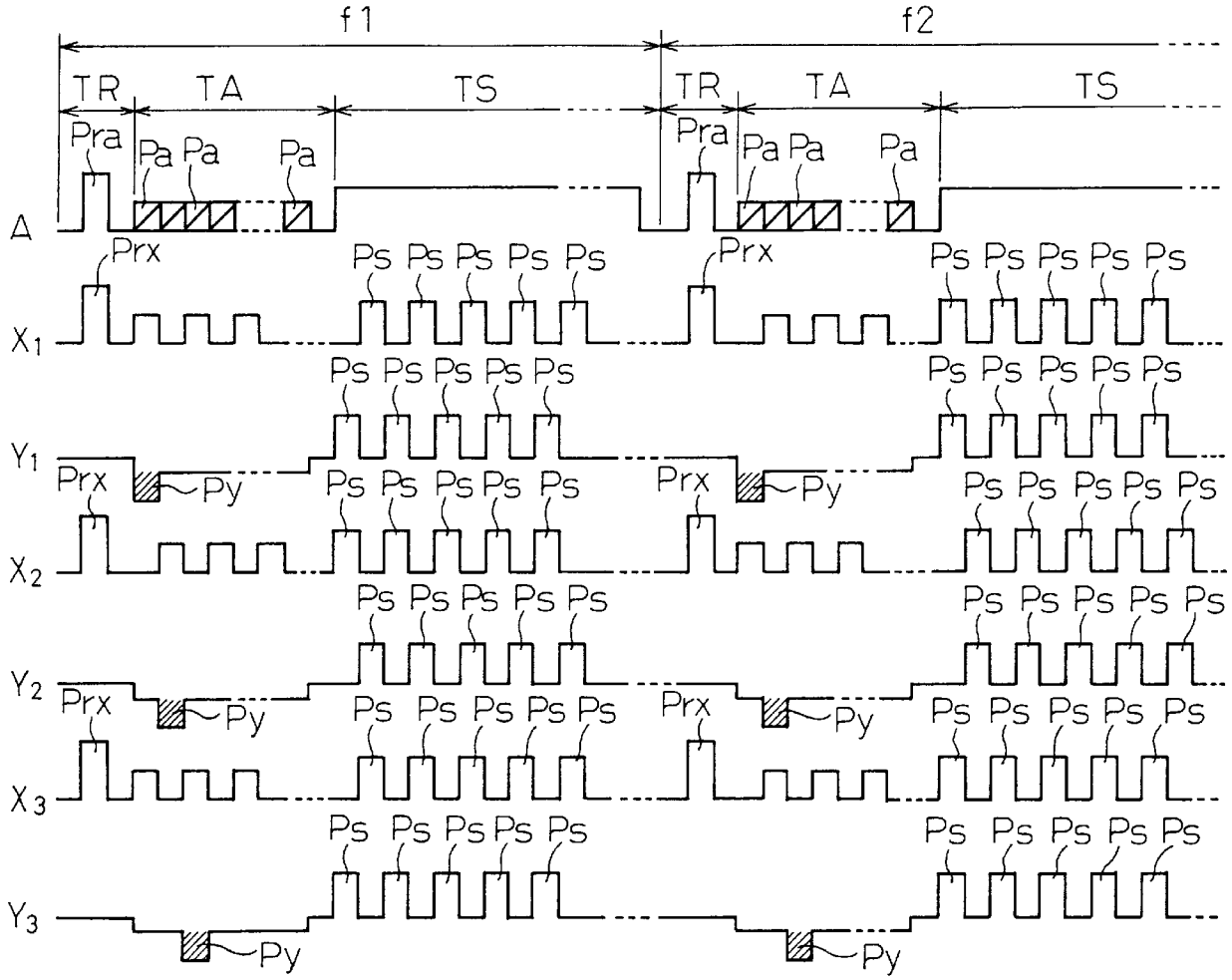
FIG. 12 is a voltage waveform diagram showing the driving sequence of a plasma display apparatus according to the third embodiment.

FIG. 12 is a voltage waveform diagram showing an example of the driving sequence. First, in each subfield of the odd field f1, a write pulse Prx having a crest value exceeding the discharge start voltage is applied to all the display electrodes X during the addressing preparation time TR. At the same time, a pulse Pra is applied for offsetting the write pulse Prx to all the address electrodes A. An excessive wall charge is formed in each cell by the surface discharge due to the application of the write pulse Prx. This wall charge is substantially erased by the self-quenching discharge at the trailing edge of the pulse.

During the addressing time TA, on the other hand, a scan pulse Py is applied to each display electrode Y sequentially for selecting the rows. In synchronism with the scan pulse Py, the address pulse Pa is applied to the address electrodes A corresponding to the cells of the selected rows to be turned on thereby to generate the address discharge. Also, in order to generate the address discharge selectively on the display rows, a pulse is applied alternately to the odd display electrodes X and the even display electrodes Y. During the sustain time TS, a sustain pulse Ps is applied to the display electrodes X and the display electrodes Y alternately for the odd rows and at the same time for the even rows.

On the other hand, in each subfield of the even field f2, the write pulse Prx is applied to all the display electrodes X during the addressing preparation time TR to erase the wall charge. Also during the addressing time TA, as in odd field f1, the scan pulse Py is applied to the display electrodes Y sequentially, while the address pulse Pa is applied to a predetermined address electrode A.

For the even field f2, a pulse is applied to the odd display electrodes X and the even display electrodes Y alternately so that the address discharge occurs selectively on the display rows in synchronism with the scan pulse Py. During the sustain time TS, on the other hand, the sustain pulse Ps is applied to the display electrodes X and the display electrodes Y alternately for the even rows and at the same time for the odd rows.

By driving the electrodes in the manner described above, a high quality image can be displayed with a low power consumption.

Figure 13:
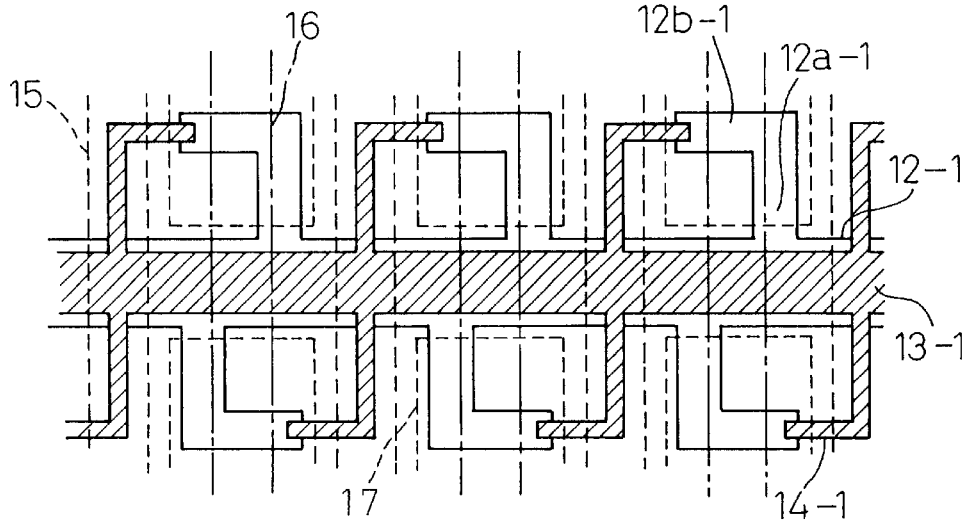
FIG. 13 is a plan view showing a modification of the display electrodes according to the third embodiment.
Figure 14:
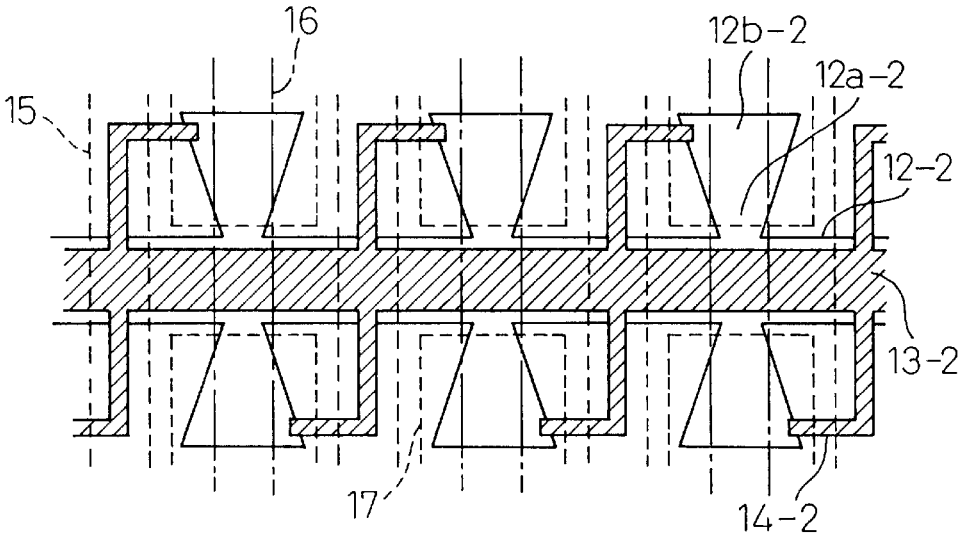
FIG. 14 is a plan view showing a modification of the display electrodes according to the third embodiment.

FIGS. 13 and 14 are diagrams showing modifications of the display electrode pattern according to the third embodiment. Both modifications have the same basic configuration in which the protrusions and the discharge portions of the transparent electrode and the auxiliary patterns of the bus electrode are formed on the two sides of the main pattern including the transparent electrode and the bus electrode overlapped with each other.

First, in the display electrode shown in FIG. 13, the transparent electrode 12-1 includes protrusions 12*a*-1 extending from the two sides of the main pattern and discharge portions 12*b*-1 bent from the protrusions 12*a*-1, respectively. The protrusions 12*a*-1 and the discharge portions 12*b*-1 are substantially L-shaped and are each arranged on the two sides of the main pattern symmetrically about a point with respect to each other. The bus electrode 13-1, on the other hand, includes auxiliary patterns 14-1 extending from the two sides of the main pattern. Each of the auxiliary patterns 14-1 has the forward end thereof bent and connected to the corresponding discharge portion 12*b*-1 of the transparent electrode 12-1. These auxiliary patterns 14-1 are arranged in overlapped relation with the partitioning walls 15 not to shield the luminous area 17.

In the display electrode shown in FIG. 14, the transparent electrode 12-2 includes trapezoidal protrusions 12*a*-2 expanding from the two sides of the main pattern and discharge portions 12*b*-2 located at the forward end of the protrusions 12*a*-2. The bus electrode 13-2, on the other hand, includes auxiliary patterns 14-2 extending from the two sides of the main pattern and each having a forward end thereof bent and connected to the corresponding discharge portion 12*b*-2 of the transparent electrode 12-2. The auxiliary patterns 14-2 are arranged in overlapped relation with the partitioning walls 15 not to shield the luminous area 17.

In this modification, the forward ends of the auxiliary patterns 14-2 of the bus electrode 13-2 are bent in different directions. Since the transparent electrode 12-2 is linearly symmetric about the bus pattern, however, the forward ends of the auxiliary patterns 14-2 may alternatively be bent in the same direction.

Figure 15:
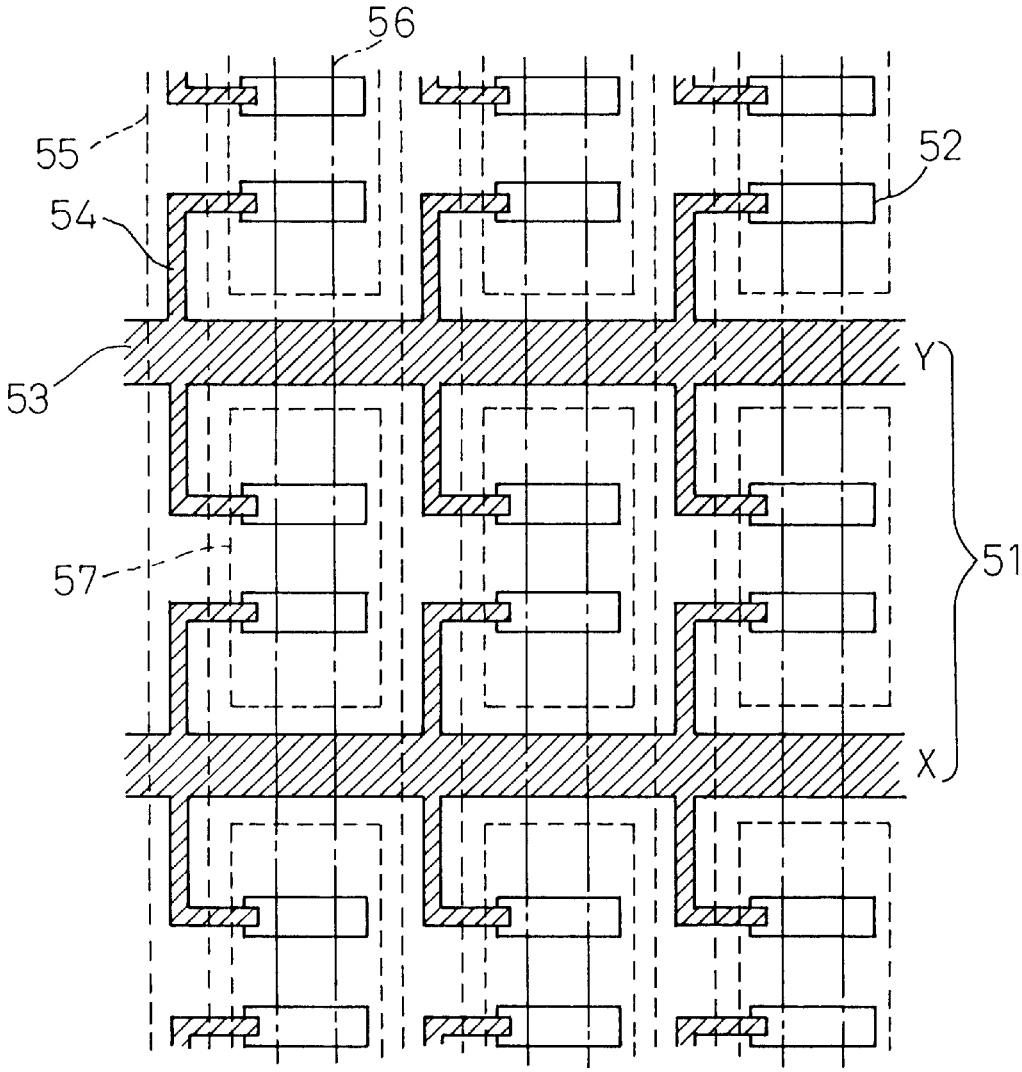
FIG. 15 is a plan view showing the display electrodes according to a fourth embodiment of the invention.

FIG. 15 is a plan view showing a display electrode pattern of the PDP according to a fourth embodiment of the invention. According to this embodiment, as shown in FIG. 15, the display electrodes X, Y make up a display electrode pair 51 for generating a sustain discharge. The PDP according to this embodiment, as in the third embodiment, meets the requirement of the ALiS driving system and is an application of the ALiS system to the display electrode pattern of the second embodiment.

The display electrodes X, Y each include transparent electrodes 52 of ITO or the like and a bus electrode 53 of a multilayer metal. These component parts are arranged in opposed symmetrical relation. The bus electrode 53 includes auxiliary patterns 54 formed at predetermined spatial intervals extending from the two sides of the band-shaped main pattern. An island-like transparent electrode 52 is arranged and connected to the forward end portion of each auxiliary pattern 54. The transparent electrodes 52 of the adjacent display electrodes are in opposed relation to each other for generating a discharge therebetween.

In this embodiment, the transparent electrodes 52 are constituted of only the island-like discharge portions and do not have any protrusions extending from the main pattern unlike the second and third embodiments. This is intended to use the auxiliary patterns 54 not only as a mere addition in case of disconnection but positively for discharge.

The partitioning walls 55 and the address electrodes 56 formed on the back substrate are arranged at positions similar to the corresponding positions in the second and third embodiments and define the luminous areas 57, respectively. Also, the transparent electrodes 52 are not arranged over the whole lower side of the bus electrode 53, thus further reducing the power consumption. With the pattern shape according to this embodiment, the area of the transparent electrodes 52 can be further reduced, making it possible to further reduce the power consumption. The transparent electrodes 52 are electrically connected by the metal auxiliary patterns 54 and therefore are not disconnected.

Figure 16:
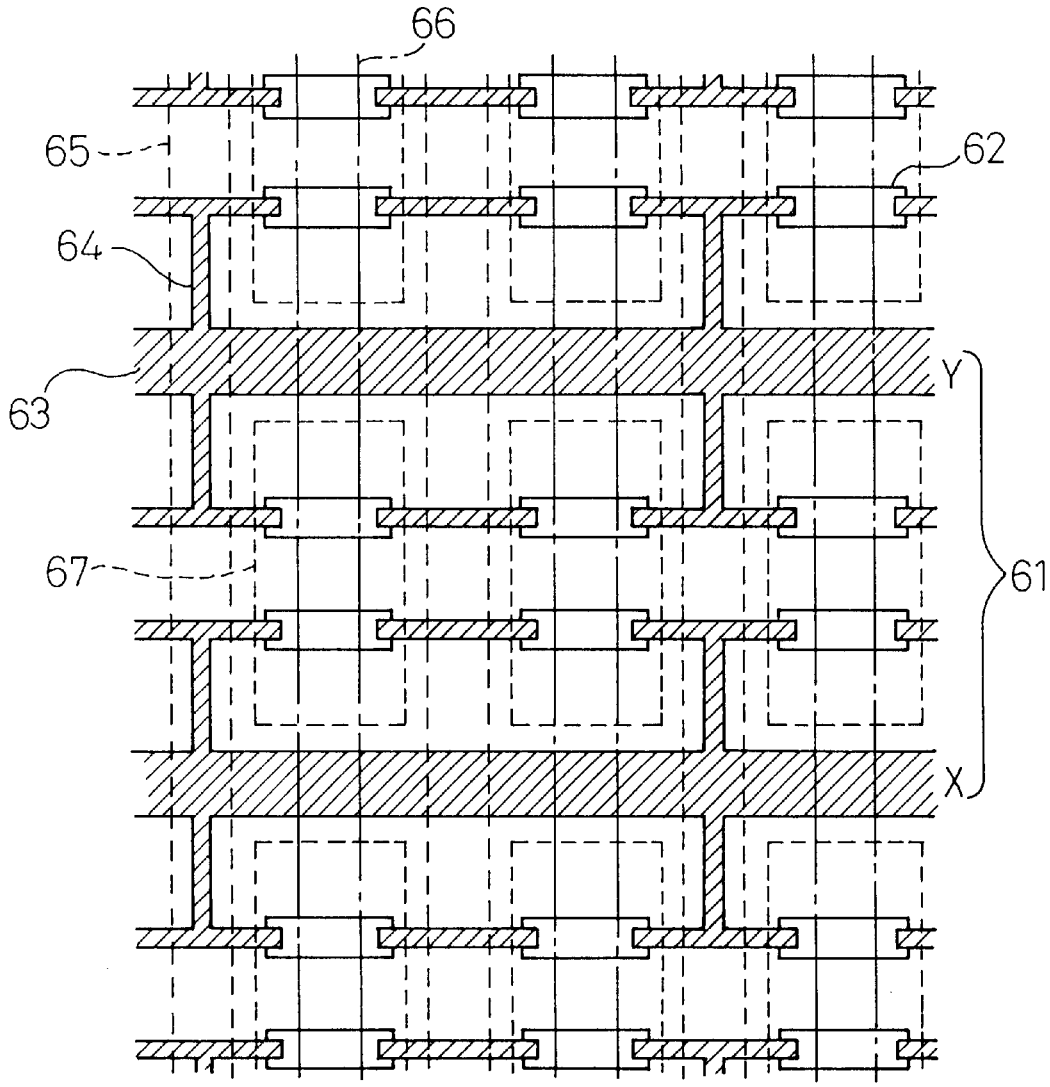
FIG. 16 is a plan view showing the display electrodes according to a fifth embodiment of the invention.

FIG. 16 is a plan view showing a display electrode pattern of the PDP according to a fifth embodiment of the invention. As shown in FIG. 10, the display electrodes X, Y constitute a display electrode pair 61 for generating a sustain discharge. This embodiment, like the third and fourth embodiments, meets the requirement for the ALiS driving system.

As can be seen from the drawings, the display electrode pattern according to the fifth embodiment is different from that of the fourth embodiment in that the auxiliary patterns 64 of the bus electrode 63 are connected to the two sides of each of island-like transparent electrodes 62. This configuration meets the requirement in case of disconnection of the transparent electrodes 62 while at the same time reducing the area of the auxiliary patterns 64. Specifically, the transparent electrodes 62 for generating the discharge have a predetermined width for discharge but constitute an elongated pattern in the other directions, thus giving rise to the possibility of disconnection under the effect of dust and scratching or damage to the substrate. By connecting the auxiliary patterns 64 of the bus electrode 63 to the two sides of each transparent electrode 62, a predetermined voltage can be applied in case of disconnection and therefore the discharge is not interrupted. Also, a pattern of the auxiliary pattern 64 extending in the direction perpendicular to the bus electrode 63 is not required to be provided in one-to-one relation with the transparent electrode 62, and therefore the area of the auxiliary patterns 64 can be reduced for smaller power consumption. In FIG. 16, an auxiliary pattern 64 is formed for every other transparent electrode 62. This number can be further reduced.

The partitioning walls 65 and the address electrodes 66 formed on the back substrate are arranged in similar positions to those in the second to fourth embodiments, and define the luminous areas 67, respectively.

Figure 17:
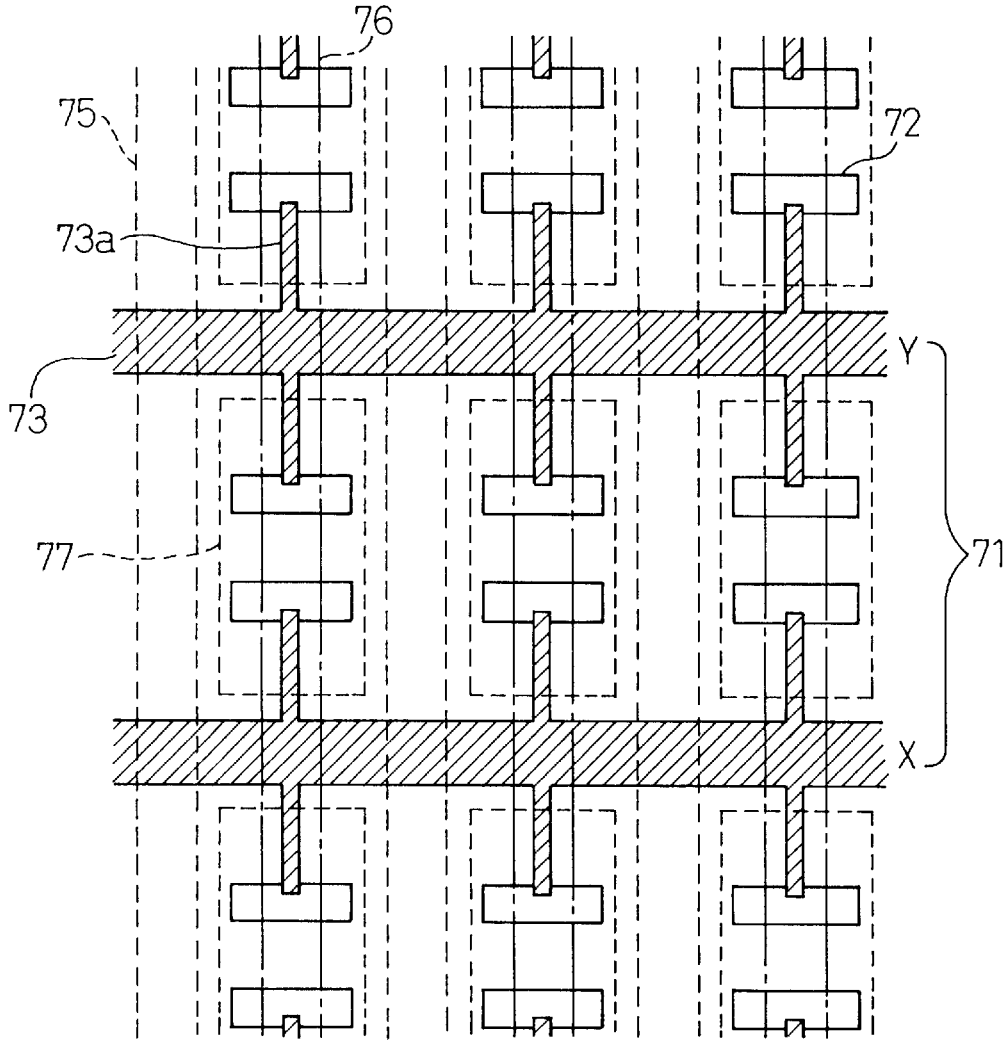
FIG. 17 is a plan view showing the display electrodes according to a sixth embodiment of the invention.

FIG. 17 is a plan view showing a display electrode pattern of the PDP according to a sixth embodiment of the invention. This embodiment, like the third to fifth embodiments, meets the requirement for the drive of ALiS system. As is clear from FIG. 17, the display electrode pattern of the display electrode pairs 71 according to the sixth embodiment is different from the fourth embodiment in that the protrusions (auxiliary patterns ) 73*a* of the bus electrode 73 are connected to the central portion of the island-like transparent electrode 72. In this configuration, each protrusion 73*a* is arranged within the luminous area 77 and therefore the luminous efficacy is somewhat reduced, but the pattern becomes so simple that the fabrication process, such as the patterning, is facilitated.

Figure 18:
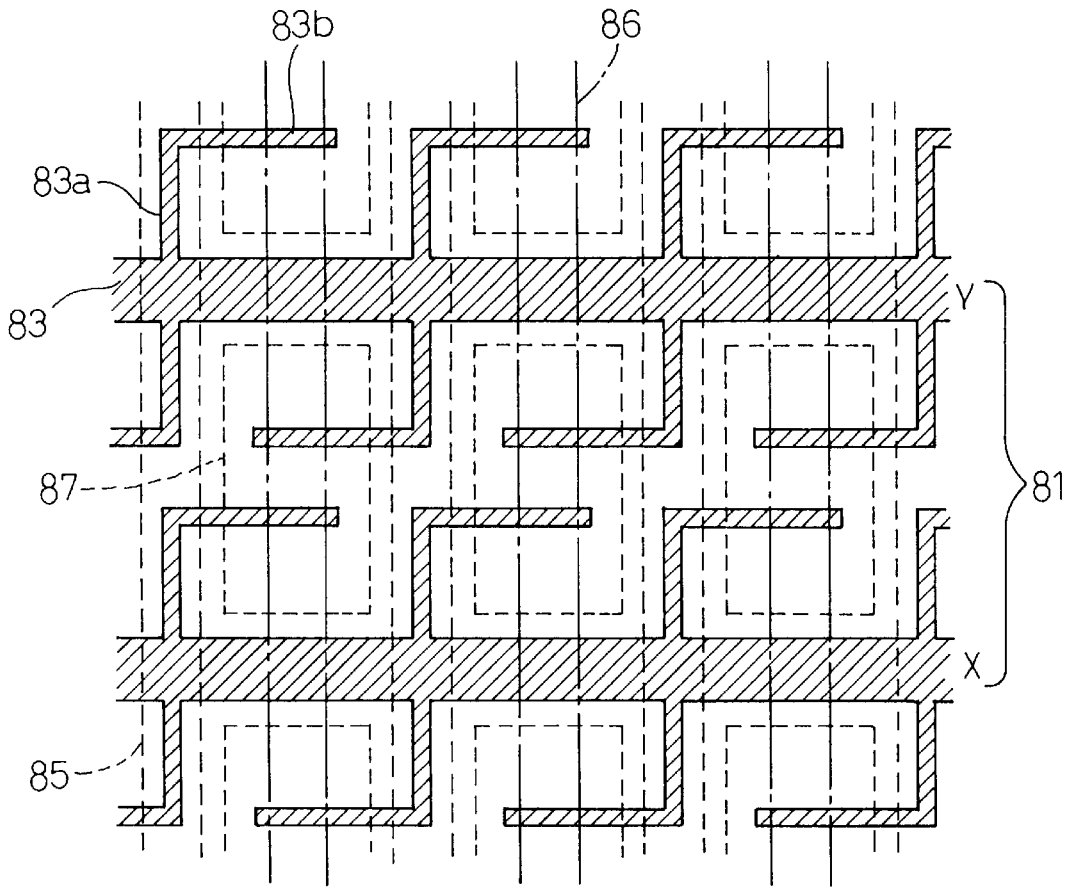
FIG. 18 is a plan view showing the display electrodes according to a seventh embodiment of the invention.

FIG. 18 is a plan view showing a display electrode pattern of the PDP according to a seventh embodiment of the invention. This embodiment, like the sixth embodiment, meets the requirement for the ALiS drive system. In the seventh embodiment, no transparent electrode is included, but a display electrode pair 81 for surface discharge is formed of only the bus electrode 83 having a higher conductivity than the transparent electrode. As shown in FIG. 18, the display electrodes X, Y constitute a display electrode pair 81 for generating the sustain discharge.

The bus electrode 83 making up the display electrodes X, Y is made of a metal layer high in conductivity such as Cr—Cu—Cr, and protrusions 83*a* extending from the two sides of each band-shaped main pattern are arranged at predetermined spatial intervals. The discharge portion 83*b* is arranged at the forward end portion of each of the protrusions 83*a*, so that the protrusion 83*a* and the discharge portion 83*b* make up a substantially L-shaped pattern. The discharge portions 83*b* of the adjacent ones of the display electrodes are arranged in opposed relation to each other to generate the discharge between them.

The protrusions 83*a* of the bus electrode 83 are arranged in overlapped relation with the partitioning walls 85 on the back substrate. From each of the overlapped portions, the discharge portion 83*b* is formed by being bent toward the luminous area 87. This discharge portions 83*b*, though higher in conductivity than the transparent electrodes, are made of a metal layer capable of shielding the light. Thus the luminous area 87 is masked without transmitting the light. However, the reduction of the brightness is prevented by setting the length of the discharge portion 83*b* to a required minimum for discharge.

According to this embodiment, the transparent electrode is not required, and therefore it is possible to remarkably reduce the number of processes and equipment for forming the display electrodes.

As described above, according to this invention, the discharge patterns are located at positions in spaced relation from the main pattern of the display electrode, and therefore the power consumption can be suppressed by eliminating the patterns therebetween, and the disconnection between the main pattern and the discharge patterns can be prevented by connecting them with auxiliary patterns made of a material high in conductivity.

The present invention is effectively applicable to a high-definition plasma display panel including a multiplicity of electrodes in the display area, and especially produces a large effect in an application, as a driving method, using all the inter-electrode spaces for display.

What is claimed is:

1. A plasma display panel of a surface discharge type comprising a pair of substrates opposed to each other with a discharge space formed therebetween and a plurality of display electrode pairs arranged in proximity to each other between said substrates, each of said display electrodes comprising:

a main pattern extending in one direction;

a plurality of discharge patterns spaced and separated from each other and spaced from said main pattern, each formed for a respective luminous area corresponding to a display cell; and a plurality of auxiliary patterns electrically connecting said main pattern and respective said discharge patterns wherein said auxiliary patterns are higher in conductivity than said discharge patterns.

2. A plasma display panel of a surface discharge type according to claim 1, wherein:

said discharge patterns are each formed of a transparent electrode material and transmit visible light, and at least a first portion of said main pattern and said auxiliary patterns are formed of a metal material higher in conductivity than that of said transparent electrode material.

3. A plasma display panel of a surface discharge type according to claim 1, further comprising:

a plurality of partitioning walls extending in a direction perpendicular to said main pattern and defining said luminous areas of said display cells; and said auxiliary patterns are arranged in overlapped relationship with said partitioning walls, respectively.

4. A plasma display panel of a surface discharge type according to claim 1, wherein:

first and second sets of said discharge patterns and said auxiliary patterns are arranged on the two sides of said main pattern, respectively, and said first and second sets of said discharge patterns are connected to a common main pattern by said first and second sets of said auxiliary patterns, respectively.

5. A plasma display panel of a surface discharge type according to claim 1, further comprising:

a plurality of coupling auxiliary patterns, higher in conductivity than said discharge patterns, connecting the discharge patterns of adjacent display cells.

6. A plasma display panel of a surface discharge type according to claim 1, wherein:

each said coupling auxiliary patterns is formed integrally with a corresponding one of said auxiliary patterns.

7. A plasma display panel of a surface discharge type according to claim 1, further comprising:

a plurality of non-discharge slits isolating adjacent display electrode pairs so as not to generate a surface discharge between said adjacent display electrode pairs.

8. A plasma display panel of a surface discharge type according to claim 1, wherein:

said discharge patterns of said display electrode pairs are arranged with a surface discharge gap formed therebetween.

9. A plasma display panel of a surface discharge type according to claim 8, wherein:

a plurality of display electrode pairs are arranged equidistantly.

10. A plasma display panel of a surface discharge type comprising a pair of substrates opposed to each other with a discharge space formed therebetween and a plurality of display electrode pairs arranged in proximity to each other between said substrates, each of said display electrodes comprising:

a main pattern extending in one direction;

a plurality of discharge patterns spaced and separated from each other, each formed for a respective luminous area corresponding to a display cell;

a plurality of auxiliary patterns spaced from each other and electrically connecting said main pattern and respective said discharge patterns; and said discharge patterns and said auxiliary patterns are formed, integrally with each other, of a light-shielding metal material.

11. A plasma display panel of a surface discharge type according to claim 10, further comprising:

a plurality of partitioning walls extending in a direction perpendicular to said main pattern and defining said luminous areas of said display cells; and said auxiliary patterns are arranged in overlapped relationship with said partitioning walls, respectively.

12. A plasma display panel of a surface discharge type according to claim 10, further comprising:

a plurality of non-discharge slits isolating adjacent display electrode pairs so as not to generate the surface discharge between said adjacent display electrode pairs.

13. A plasma display panel of a surface discharge type according to claim 10, wherein:

said discharge patterns of said display electrode pairs are arranged with a surface discharge gap formed therebetween.

14. A plasma display panel of a surface discharge type according to claim 13, wherein:

a plurality of display electrode pairs are arranged equidistantly.

15. A plasma display panel of a surface discharge type comprising a pair of substrates opposed to each other with a discharge space therebetween and a plurality of display electrode pairs arranged in proximity to each other between said substrates and defining a plurality of luminous areas therebetween, each of said display electrodes comprising:

a main pattern of a band shape extending in a first direction;

a plurality of discharge patterns spaced and separated from each other and spaced from said main pattern, each formed for a respective luminous area corresponding to a display cell;

a plurality of coupling patterns connecting said discharge patterns and said main pattern to each other, said coupling patterns being separated from each other and a width of each of said coupling patterns being narrower than a width of each of said discharge patterns in the direction in which said main pattern extends; and spaced and separate auxiliary patterns electrically connecting said main pattern and respective discharge portions of corresponding discharge patterns.

16. A plasma display panel of a surface discharge type according to claim 15, wherein:

said discharge patterns and said coupling patterns are each formed of a transparent electrode material and transmit visible light, and at least a first portion of said main pattern and said auxiliary patterns are formed of a metal material higher in conductivity than that of said transparent electrode material.

17. A plasma display panel of a surface discharge type according to claim 15, wherein:

said main pattern has a multilayer structure of a transparent conductive material layer and a metal material layer as the first portion, said discharge patterns are formed integrally with said respective coupling patterns and the latter are formed integrally with said transparent conductive material layer of said main pattern, and each of said auxiliary patterns is formed integrally with the metal material layers of said main pattern.

18. A plasma display panel of a surface discharge type according to claim 15, further comprising:

a plurality of partitioning walls extending in a direction perpendicular to said main pattern and defining said luminous areas of said display cells; and said auxiliary patterns are arranged in overlapped relationship with said partitioning walls, respectively.

19. A plasma display panel of a surface discharge type according to claim 15, wherein:

first and second sets of said discharge patterns and said auxiliary patterns are arranged on the two sides of said main pattern, respectively, and said first and second sets of said discharge patterns are connected to a common main pattern by said first and second sets of said auxiliary patterns, respectively.

20. A plasma display panel of a surface discharge type according to claim 15, further comprising:

a plurality of non-discharge slits isolating adjacent display electrode pairs so as not to generate a surface discharge between said adjacent display electrode pairs.

21. A plasma display panel of a surface discharge type according to claim 15, wherein:

said discharge patterns of said display electrode pairs are arranged with a surface discharge gap formed therebetween.

* * * * *